US005360323A

United States Patent [19]

Hsieh

[11] Patent Number: 5,360,323

[45] Date of Patent: Nov. 1, 1994

[54] AQUARIUM AIR PUMP

[76] Inventor: Ting-Shin Hsieh, No. 317 Nanking W. Road, Taipei, Taiwan, Province of China

[21] Appl. No.: 57,260

[22] Filed: May 4, 1993

[51] Int. Cl.[5] ..... F04B 17/00

[52] U.S. Cl. ..... 417/413.1

[58] Field of Search ..... 417/413; 92/13.2

[56] References Cited

U.S. PATENT DOCUMENTS

| | | | |
|---|---|---|---|
| 3,825,374 | 7/1974 | Kondo | 417/413 R |
| 4,671,485 | 6/1987 | Saarem | 92/13.2 |
| 5,052,904 | 10/1991 | Itakura et al. | 417/413 R |
| 5,232,353 | 8/1993 | Grant | 417/413 R |

FOREIGN PATENT DOCUMENTS

| | | | |
|---|---|---|---|
| 63-16180 | 1/1988 | Japan | 417/413 R |

*Primary Examiner*—Richard A. Bertsch
*Assistant Examiner*—Alfred Basichas
*Attorney, Agent, or Firm*—Pro-Techtor International

[57] ABSTRACT

An improvement of an aquarium air pump, which is characterized by the fact that one end of an air-compressing diaphragm in the air pump is slipped into the intake valve housing of the air pump, while the other end is bound to a vibrating lever as one unit, that the diaphragm should be made of Teflon® or silicone rubber, that a limiting rod is placed at an appropriate position in the casing of the air pump and is allowed also to press against the vibrating lever. With the configuration pertaining to the present invention, the air pump can compress air more effectively and the working life of the diaphragm can be prolonged by preventing it from being damaged caused by back pressure in the event the air outlet is clogged.

4 Claims, 2 Drawing Sheets

AQUARIUM AIR PUMP

FIELD OF THE INVENTION

The present invention concerns an improvement of an aquarium air pump, and, in particular, the configuration of the diaphragm in an air pump for allowing the air pump to compress air more effectively and prolonging the working life of the diaphragm.

DESCRIPTION OF THE PRIOR ART

As shown in FIG. 1 (see U.S. Pat. No. 3,825,374), the configuration of conventional air pumps principally consists of a casing 1, which is equipped with an electromagnetic coil set 11, an air intake valve housing 12 seated in front of the electromagnetic coil 11, two vibrating levers 13 placed separately on each side of the valve housing 12, a magnet 131 secured on the front tip of said vibrating lever 13 which can cause each of the vibrating levers 13 to vibrate repetitively by means of attraction between the electromagnetic coil 11 and the magnet 131, and a rubber diaphragm 14 bound to the middle section of each of the vibrating levers 13, with the other end of said diaphragm 14 being clipped onto the groove 121 of the air intake valve housing 12 through its protruding flange 141, causing the diaphragm 14 to vibrate along with the vibrating lever 13, thereby compressing the air in the valve housing air chamber 122, and discharging it through a closed circuit in the valve housing 12 into the aquarium through an airstone. It is commonly known for those who have aquariums that this type of air pumps lasts approximately one year and then the unit has to be replaced because the rubber diaphragm 14 cracks due to aging. There are two causes relating to said aging problem. One of the causes is that the fitting configuration pertaining to the diaphragm 14 and air intake housing 12 is not ideal, and the other cause is that the material employed for fabricating the diaphragm 14 is inferior. Furthermore, these two factors give rise to multiplying effects, which accelerate the aging and cracking of the diaphragm 14. In addition, the rubber diaphragm 14 is susceptible to degradation by air containing acidic or alkaline matters, causing it to gradually age and crack. Moreover, even the diaphragm 14 which has not yet shown signs of aging is subjected to a higher rate of aging due to the fact that said diaphragm is being pushed, pulled and compressed repetitively for a long period of time. As commonly known, algae, floating matters and inorganic matters are formed in the aquarium due to the presence of fish foods, wastes produced by fish and extraneous matters in air. The algae, floating matters and inorganic matters adsorb readily onto the airstone, causing clogging. Once the surface of the airstone is clogged, the compressed air exerts back pressure that acts on the diaphragm 14, tearing apart said rubber diaphragm.

SUMMARY OF THE INVENTION

In light of these problems, the inventor of the present invention conducted numerous studies and improvements, and arrived at the present invention after developing an air pump diaphragm with a novel configuration. Specifically, the present invention is characterized by the fact that said diaphragm is prevented from being torn easily by binding one end of said air pump diaphragm to a vibrating lever and slipping the other end into the intake valve housing of the air pump, so that said diaphragm is not subjected to pulling or squeezing by the vibrating lever during air compression.

The other characteristic of the present invention is that the working life of said air pump diaphragm is prolonged by fabricating it out of Teflon® or silicone rubber that does not degrade by acidic or alkaline matters in air or in the aquarium.

DESCRIPTION OF THE PREFERRED EMBODIMENT

Figure 1:
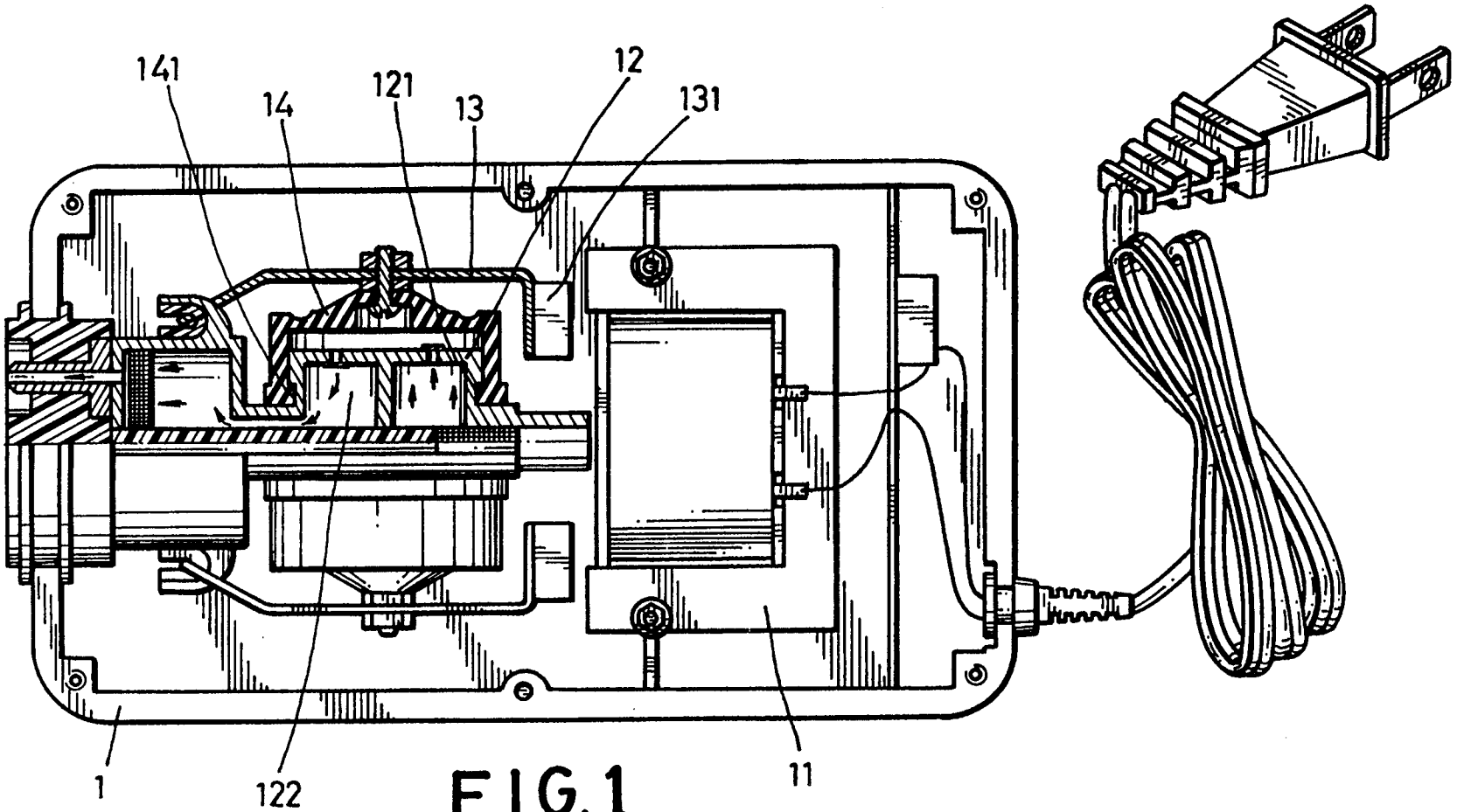
FIG. 1 PRIOR ART
FIG. 1 is a component dissection figure of a conventional air pump.
Figure 2:
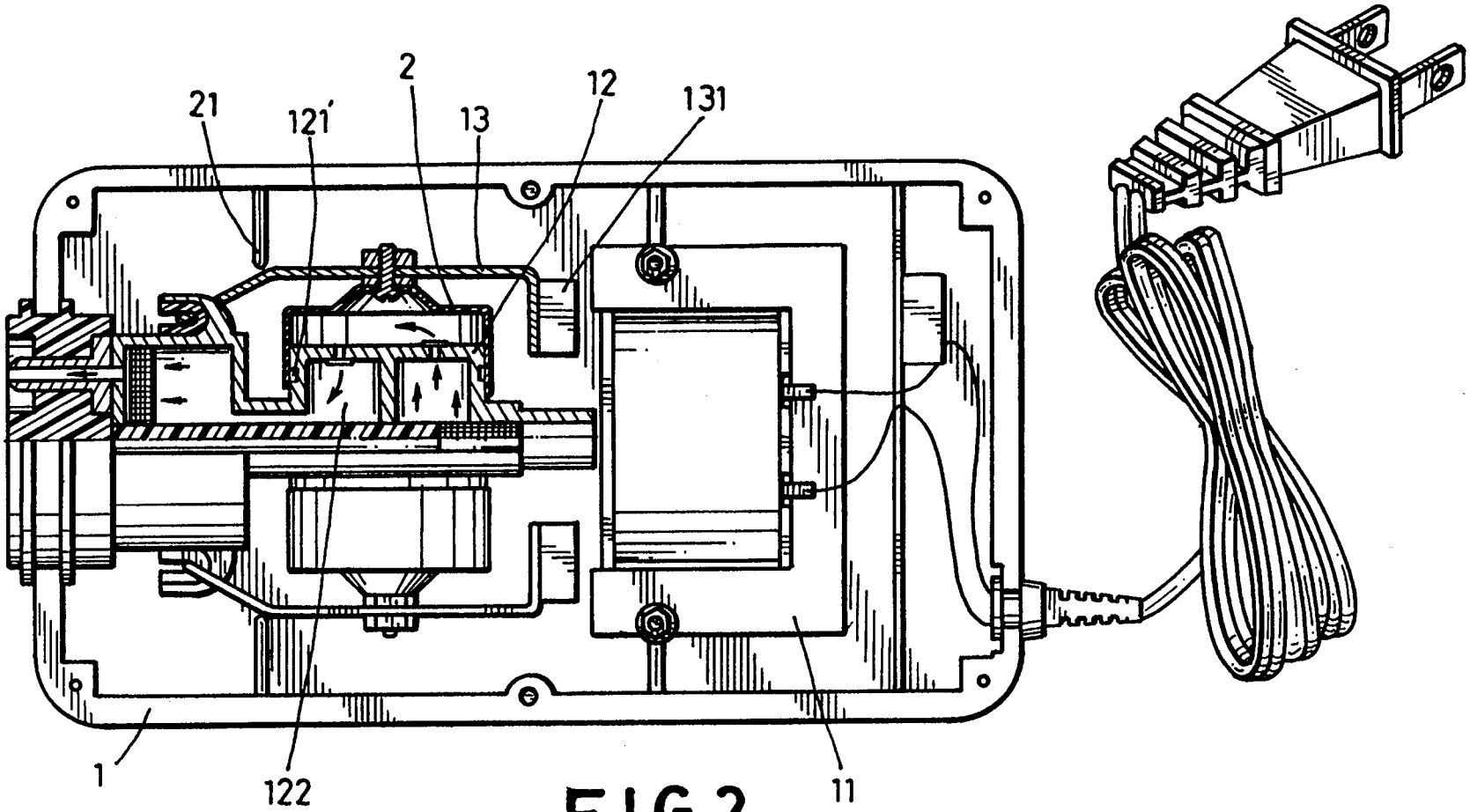
FIG 2 is a component dissection figure of an aquarium air pump according to the present invention.

As shown in FIG. 2, the air pump pertaining to the present invention consists of a casing 1, which is equipped with an electromagnetic coil set 11, an air intake valve housing 12 seated in front of the electromagnetic coil 11, two vibrating levers 13 placed separately on each side of the valve housing 12, a magnet 131 secured on the front tip of said vibrating lever 13 which can cause each of the vibrating levers 13 to vibrate repetitively by means of attraction between the electromagnetic coil 11 and the magnet 131 (the aforesaid components are essentially the same as those used conventionally), and a diaphragm 2 bound to the middle section of each of the vibrating levers 13. Said diaphragm 2 is preferably fabricated out of Teflon® or silicone rubber that resists degradation by acids or bases and oxidation, and slips directly onto the air valve housing 12 (these are the principal characteristics of the present invention). Since it is not required that the diaphragm 2 be clipped to the groove 121 of the air intake valve housing 12, the flange of said diaphragm's body does not have to be protruded, which allows the diaphragm 2 to slide easily. When the electromagnetic coil 11 acts on the vibrating lever 13, thereby causing the diaphragm 2 to compress air in the valve housing air chamber 122, said diaphragm 2 is not subjected to squeezing. When the diaphragm 2 is extended outward by the vibrating lever 13, the diaphragm 2 is not subject to pulling. Accordingly, the working life of the diaphragm 2 is prolonged. In addition, a limiting rod 21 is placed in the casing 1 at an appropriate position of the vibrating lever 13 and presses against said vibrating lever 13, thereby preventing the vibrating lever 13 from extended outward excessively by means of the limiting action of said limiting rod 22 and increasing the efficiency of air compression by the diaphragm 2: Furthermore, a groove 121' on said air intake valve housing 12 is situated in the outer side of the air intake valve housing 12. In the event the airstone is clogged, causing back pressure by the compressed air, said compressed air then can escape through the groove 121', preventing the diaphragm 2 from being torn. Accordingly, the present invention possesses the following merits:

1. By employing the configuration in which the diaphragm slips onto the air valve housing, the diaphragm, when operating, is not compressed or stretched by external forces, and tearing caused by compressed air back pressure is prevented. Thereby, the working life of the diaphragm can be prolonged.
2. By employing a special material to fabricate the diaphragm, said diaphragm is not subjected to degradation by chemical substances in the aquarium or air, and can sit tightly onto the air intake valve housing.

3. By employing the configuration in which a limiting rod in the casing is pressed against the vibrating lever, the vibrating lever can cause the diaphragm to operate efficiently.

In summary, the inventor is applying for a patent for the present invention after comparing the merits thereof with those of conventional aquarium air pumps and confirming that the present invention can bring about a longer working life of aquarium air pumps and an increase in the efficiency of air compression.

I claim:

1. An improved aquarium air pump comprising:

a casing equipped with an electromagnetic coil set, an air intake valve housing seated in front of the electromagnetic coil.

two vibrating levers, one lever placed on a top side of said intake valve housing, and the second lever placed on a bottom side of said intake valve housing, the levers vibrating repetitively when a magnet on a front tip of said vibrating levers is attracted by said electromagnetic coil, and a diaphragm connected to a middle section of the vibrating levers, characterized by the fact that the diaphragm is slipped directly onto said air intake valve housing, and a flange of the body of said diaphragm does not have any protruding edges.

2. The aquarium air pump as claimed in claim 1 wherein:

said diaphragm is made from a smooth durable material which resists oxidation and degradation by acids or bases.

3. The aquarium air pump as claimed in claim 1 wherein:

two limiting rods are placed in the casing of said air pump and press against the vibrating levers, thereby preventing the vibrating levers from extending the diaphragm outward excessively and increasing the efficiency of air compression by the diaphragm.

4. The aquarium air pump as claimed in claim 1 wherein:

a groove of said air intake valve housing is situated on an outer side thereof, so that compressed air can be released when back pressure from the aquarium becomes too high.

* * * * *